US007144224B2

(12) United States Patent
Kim et al.

(10) Patent No.: US 7,144,224 B2
(45) **Date of Patent: *Dec. 5, 2006**

(54) VARIABLE CAPACITY ROTARY COMPRESSOR

(75) Inventors: Gyu Woo Kim, Suwon (KR); Jun Young Lee, Yongin (KR); Dong Lyoul Shin, Suwon (KR); Seung Kap Lee, Suwon (KR); Cheol Woo Kim, Seongnam (KR); Valery Krasnoslobodtsev, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 261 days.

This patent is subject to a terminal disclaimer.

(21) Appl. No.: 10/807,261

(22) Filed: Mar. 24, 2004

(65) Prior Publication Data

US 2005/0002814 A1 Jan. 6, 2005

(30) Foreign Application Priority Data

Jul. 2, 2003 (KR) ..... 10-2003-0044462

(51) Int. Cl.
*F04B 49/00* (2006.01)

(52) U.S. Cl. ..... 417/218; 417/221; 417/326; 418/60; 418/63; 418/69; 418/109

(58) Field of Classification Search ..... 418/23, 418/60, 63, 69, 57, 109; 417/221, 326, 218
See application file for complete search history.

(56) References Cited

U.S. PATENT DOCUMENTS 713,301 A * 11/1902 Hagerty ..... 418/109
1,789,842 A * 1/1931 Rolaff ..... 418/63
5,236,318 A * 8/1993 Richardson, Jr. ..... 418/63
5,871,342 A 2/1999 Harte et al.
6,796,773 B1 * 9/2004 Choi et al. ..... 417/221
6,860,724 B1 * 3/2005 Cho et al. ..... 417/218
6,910,872 B1 * 6/2005 Cho et al. ..... 418/60

FOREIGN PATENT DOCUMENTS

JP 59063393 A * 4/1984
JP 05180183 A * 7/1993

* cited by examiner

*Primary Examiner*—Theresa Trieu
(74) *Attorney, Agent, or Firm*—Staas & Halsey LLP

(57) ABSTRACT

A variable capacity rotary compressor is designed to prevent eccentric bushes from slipping during a compression operation, and thereby prevent noise from being generated and increase durability. The variable capacity rotary compressor includes a housing to define first and second compression chambers having different capacities therein. First and second eccentric cams are mounted to a rotating shaft to be placed in the first and second compression chambers, respectively. First and second eccentric bushes are rotatably fitted over the first and second eccentric cams, respectively. First and second rollers are rotatably fitted over the first and second eccentric bushes, respectively. First and second vanes partition the first and second compression chambers, respectively. A locking unit functions to make one of the first and second eccentric bushes be eccentric from the rotating shaft while making a remaining one of the first and second eccentric bushes be released from eccentricity from the rotating shaft, according to a rotating direction of the rotating shaft. A restraining unit is outwardly projected from the rotating shaft by a centrifugal force when the rotating shaft is rotated, thus restraining the first and second eccentric bushes.

20 Claims, 9 Drawing Sheets

VARIABLE CAPACITY ROTARY COMPRESSOR

CROSS-REFERENCE TO RELATED APPLICATIONS

This application claims the benefit of Korean Application No. 2003-44462, filed Jul. 2, 2003, in the Korean Intellectual Property Office, the disclosure of which is incorporated herein by reference.

BACKGROUND OF THE INVENTION

1. Field of the Invention

The present invention relates, in general, to rotary compressors and, more particularly, to a variable capacity rotary compressor which is capable of varying a capacity of compressing a refrigerant as desired.

2. Description of the Related Art

Generally, a compressor is installed in a refrigeration system, such as an air conditioner and a refrigerator, which functions to cool air in a given space using a refrigeration cycle. In the refrigeration system, the compressor functions to compress a refrigerant which circulates through a refrigeration circuit of the refrigeration system. A cooling capacity of the refrigeration system is determined according to a compression capacity of the compressor. Thus, when the compressor is constructed to vary the compression capacity thereof as desired, the refrigeration system may be operated under an optimum condition, according to a difference between an environmental temperature and a preset reference temperature, thus allowing air in a given space to be efficiently cooled, and saving energy.

In the refrigeration system have been used a variety of compressors, for example, rotary compressors, reciprocating compressors, etc. The present invention relates to the rotary compressor, which will be described in the following.

The conventional rotary compressor includes a hermetic casing, with a stator and a rotor being installed in the hermetic casing. A rotating shaft penetrates through the rotor. An eccentric cam is integrally provided on an outer surface of the rotating shaft. A roller is provided in a compression chamber to be fitted over the eccentric cam. The rotary compressor constructed as described above is operated as follows. As the rotating shaft rotates, the eccentric cam and the roller execute eccentric rotation in the compression chamber. At this time, a gas refrigerant is drawn into the compression chamber and then compressed, prior to discharging the compressed refrigerant to an outside of the hermetic casing.

However, the conventional rotary compressor has a problem in that the rotary compressor is fixed in a compression capacity thereof, so that it is impossible to vary the compression capacity according to a difference between an environmental temperature and a preset reference temperature.

In a detailed description, when the environmental temperature is considerably higher than the preset reference temperature, the compressor must be operated in a large capacity compression mode to rapidly lower the environmental temperature. Meanwhile, when the difference between the environmental temperature and the preset reference temperature is not large, the compressor must be operated in a small capacity compression mode so as to save energy. However, it is impossible to change the capacity of the rotary compressor according to the difference between the environmental temperature and the preset reference temperature, so that the conventional rotary compressor does not efficiently cope with a variance in temperature, thus leading to a waste of energy.

SUMMARY OF THE INVENTION

Accordingly, it is an aspect of the present invention to provide a variable capacity rotary compressor which is constructed so that a compression operation is executed in either of two compression chambers having different capacities by an eccentric unit mounted to a rotating shaft, thus varying a compression capacity as desired.

It is another aspect of the present invention to provide a variable capacity rotary compressor, which is designed to prevent the eccentric unit from slipping during a compression operation, thus preventing noise from being generated and increasing durability.

Additional aspects and/or advantages of the invention will be set forth in part in the description which follows and, in part, will be obvious from the description, or may be learned by practice of the invention.

The above and/or other aspects are achieved by providing a variable capacity rotary compressor, including a housing, a rotating shaft, first and second eccentric cams, first and second eccentric bushes, first and second rollers, first and second vanes, a locking unit, and a restraining unit. The housing defines first and second compression chambers having different capacities therein. The rotating shaft is rotated in the first and second compression chambers. The first and second eccentric cams are mounted to the rotating shaft to be placed in the first and second compression chambers, respectively. The first and second eccentric bushes are rotatably fitted over the first and second eccentric cams, respectively. The first and second rollers are rotatably fitted over the first and second eccentric bushes, respectively. The first vane is installed in the first compression chamber to be reciprocated in a radial direction of the rotating shaft while being in contact with the first roller, and the second vane is installed in the second compression chamber to be reciprocated in the radial direction of the rotating shaft while being in contact with the second roller. The locking unit is mounted to the rotating shaft, and functions to make one of the first and second eccentric bushes be eccentric from the rotating shaft while making a remaining one of the first and second eccentric bushes be released from eccentricity from the rotating shaft, according to a rotating direction of the rotating shaft. Thus, the first and second eccentric bushes are eccentric in opposite directions. The restraining unit is outwardly projected from the rotating shaft by a centrifugal force when the rotating shaft is rotated, thus restraining the first and second eccentric bushes.

According to an aspect of the invention, the restraining unit includes a restraining member, a locking part, and a return spring. The restraining member reciprocates in the radial direction of the rotating shaft to be outwardly projected from the rotating shaft by the centrifugal force when the rotating shaft is rotated. The locking part is provided at a predetermined position of the first and second eccentric bushes to be locked by the restraining member when the restraining member is outwardly projected from the rotating shaft. The return spring is included in the rotating shaft to inwardly bias the restraining member in the radial direction toward a central axis of the rotating shaft when the rotating shaft is not rotated, thus releasing the eccentric bushes.

According to an aspect of the invention, the restraining unit also includes a support pin which is mounted to the rotating shaft to pass through the restraining member in a longitudinal direction of the restraining member, and functions to guide a reciprocating movement and to restrict a moving range of the restraining member. The return spring is placed between an inner surface of the restraining member and an outer surface of the support pin which passes through the restraining member.

According to an aspect of the invention, the locking unit includes a locking pin mounted to the rotating shaft to be projected from the rotating shaft, and locking parts provided at opposite positions of the eccentric bushes, respectively, to allow the locking pin to be locked by either of the locking parts to make one of the first and second eccentric bushes be eccentric from the rotating shaft while making the remaining one of the first and second eccentric bushes be released from eccentricity from the rotating shaft, according to the rotating direction of the rotating shaft.

According to an aspect of the invention, the restraining unit includes a restraining member, a support pin, and a return spring. The restraining member is installed in the rotating shaft at a position opposite to the locking pin, and reciprocates in a radial direction of the rotating shaft to be outwardly projected from the rotating shaft by the centrifugal force when the rotating shaft is rotated. The support pin is mounted to the rotating shaft to pass through the restraining member in a longitudinal direction of the restraining member, and functions to guide a reciprocating movement and to restrict a moving range of the restraining member. The return spring is placed between an inner surface of the restraining member through which the support pin passes, and an outer surface of the support pin to inwardly bias the restraining member toward a central axis of the rotating shaft when the rotating shaft is not rotated, thus releasing the eccentric bushes.

According to an aspect of the invention, the first and second eccentric bushes are eccentrically positioned from the rotating shaft in opposite directions, and are connected to each other into a single structure by a cylindrical connecting part. The locking unit includes the locking pin, and a locking slot. The locking pin is mounted to the rotating shaft to be projected from the rotating shaft. The locking slot is provided around the cylindrical connecting part to engage with the locking pin which is rotated by a predetermined range within the locking slot. When the locking pin is in contact with one of first and second ends of the locking slot, one of the first and second eccentric bushes is eccentric from the rotating shaft while a remaining one of the first and second eccentric bushes is released from eccentricity from the rotating shaft.

According to an aspect of the invention, the restraining unit includes the restraining member which is installed in the rotating shaft at a position opposite to the locking pin, and reciprocates in a radial direction of the rotating shaft to be outwardly projected from the rotating shaft by the centrifugal force when the rotating shaft is rotated. The restraining member is locked by an end of the locking slot which is opposite to the locking pin.

According to an aspect of the invention, the return spring is supported at a first end thereof by a stepped stop part which is provided at an end of the support pin and has a larger diameter, and is supported at a second end thereof by a stepped locking portion which is provided on an inner surface of the restraining member.

According to an aspect of the invention, the restraining member has a stepped outer surface with an outer diameter increased in a direction from an inside to an outside of the rotating shaft, and a stepped part having a same shape as the stepped outer surface of the restraining member is provided at a predetermined portion of the rotating shaft to receive the restraining member therein while allowing the restraining member to be retractable.

According to an aspect of the invention, an eccentric part having a same shape as the eccentric cams, is provided on an outer surface of the rotating shaft to allow the locking unit and the restraining unit to be mounted to the rotating shaft through the eccentric part.

BRIEF DESCRIPTION OF THE DRAWINGS

The above and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
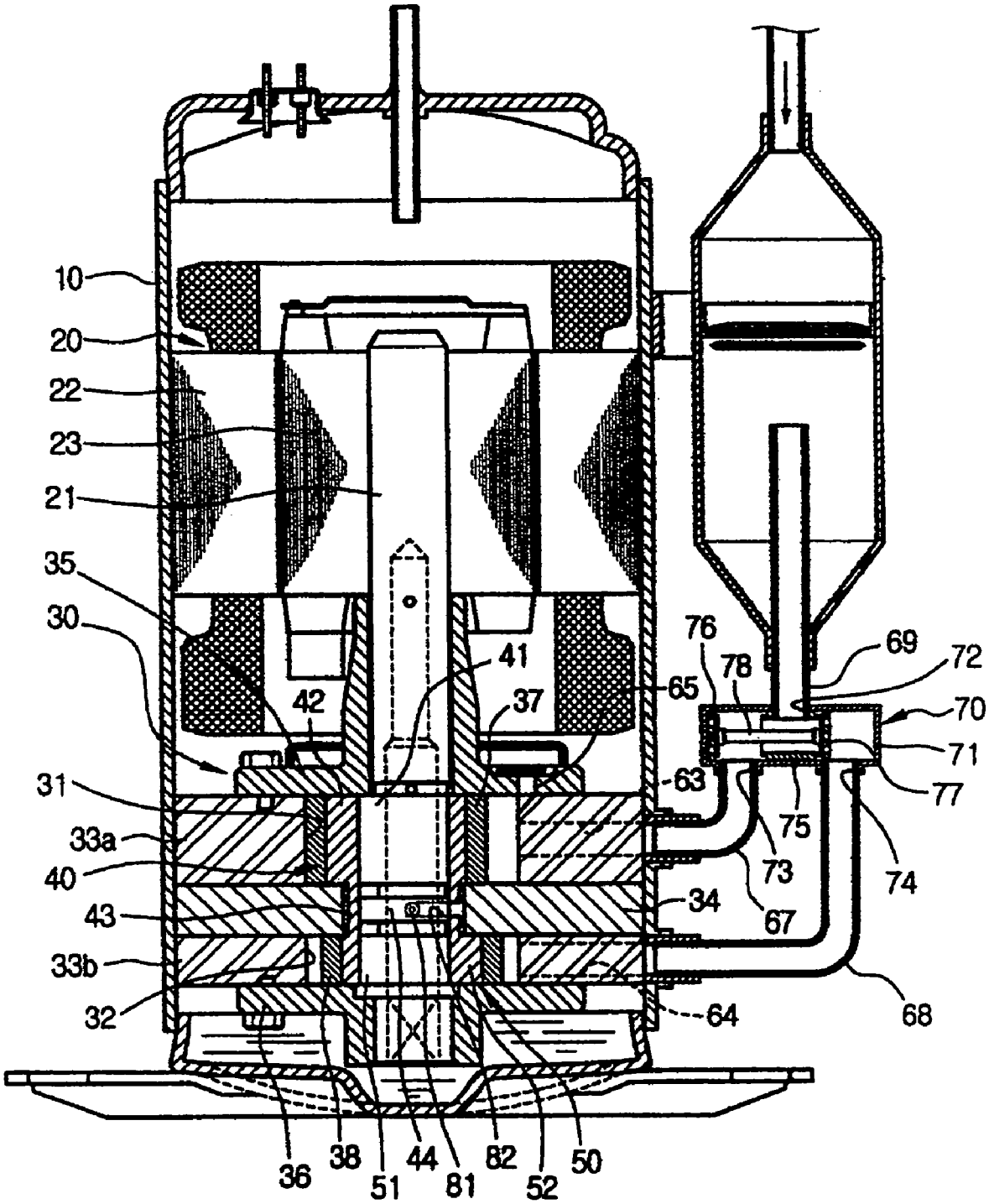
FIG. 1 is a sectional view illustrating a variable capacity rotary compressor, according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

As illustrated in FIG. 1, a variable capacity rotary compressor according to an embodiment of the present invention includes a hermetic casing 10. A drive unit 20 is installed in the casing 10 to be placed on an upper portion of the casing 10, and generates a rotating force. A compressing unit 30 is installed in the casing 10 to be placed on a lower portion of the casing 10, and is connected to the drive unit 20 through a rotating shaft 21. The drive unit 20 includes a cylindrical stator 22, and a rotor 23. The stator 22 is mounted to an inner surface of the casing 10. The rotor 23 is rotatably and concentrically set in the stator 22, and is mounted to the rotating shaft 21 which is placed at a center of the casing 10. The drive unit 20 rotates the rotating shaft 21 forwards or backwards.

The compressing unit 30 includes upper and lower housings 33*a* and 33*b* which define first and second compression chambers 31 and 32, respectively. The first and second compression chambers 31 and 32 are both cylindrical but have different capacities. An upper flange 35 is mounted to an upper surface of the upper housing 33*a* to close an upper portion of the first compression chamber 31, and a lower flange 36 is mounted to a lower surface of the lower housing 33*b* to close a lower portion of the second compression chamber 32. Further, the upper and lower flanges 35 and 36 function to rotatably support the rotating shaft 21. A partition plate 34 is interposed between the upper and lower housings 33*a* and 33*b* to partition the first and second compression chambers 31 and 32 into each other.

Figure 2:
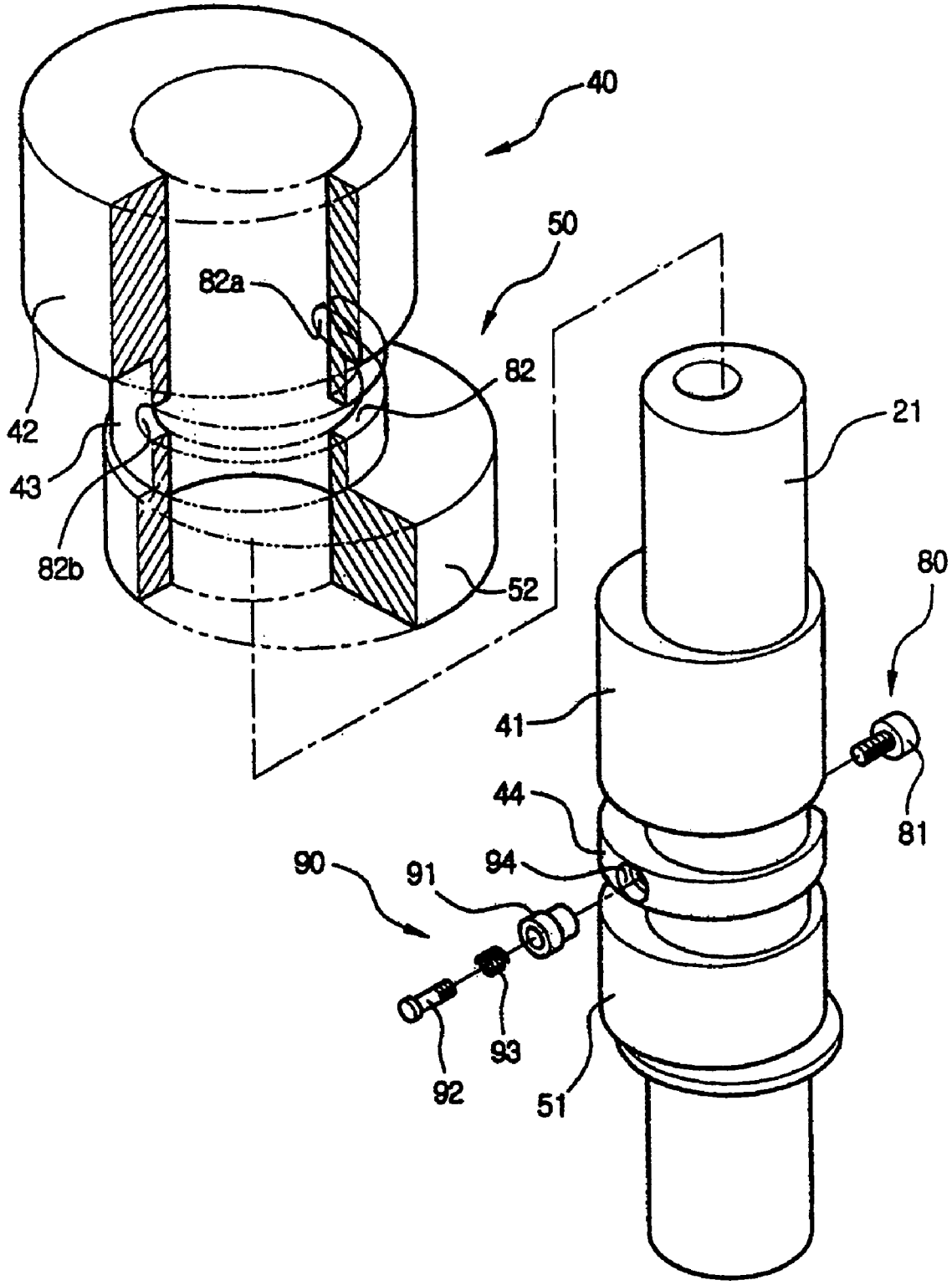
FIG. 2 is an exploded perspective view of an eccentric unit included in the variable capacity rotary compressor of FIG. 1.
Figure 3:
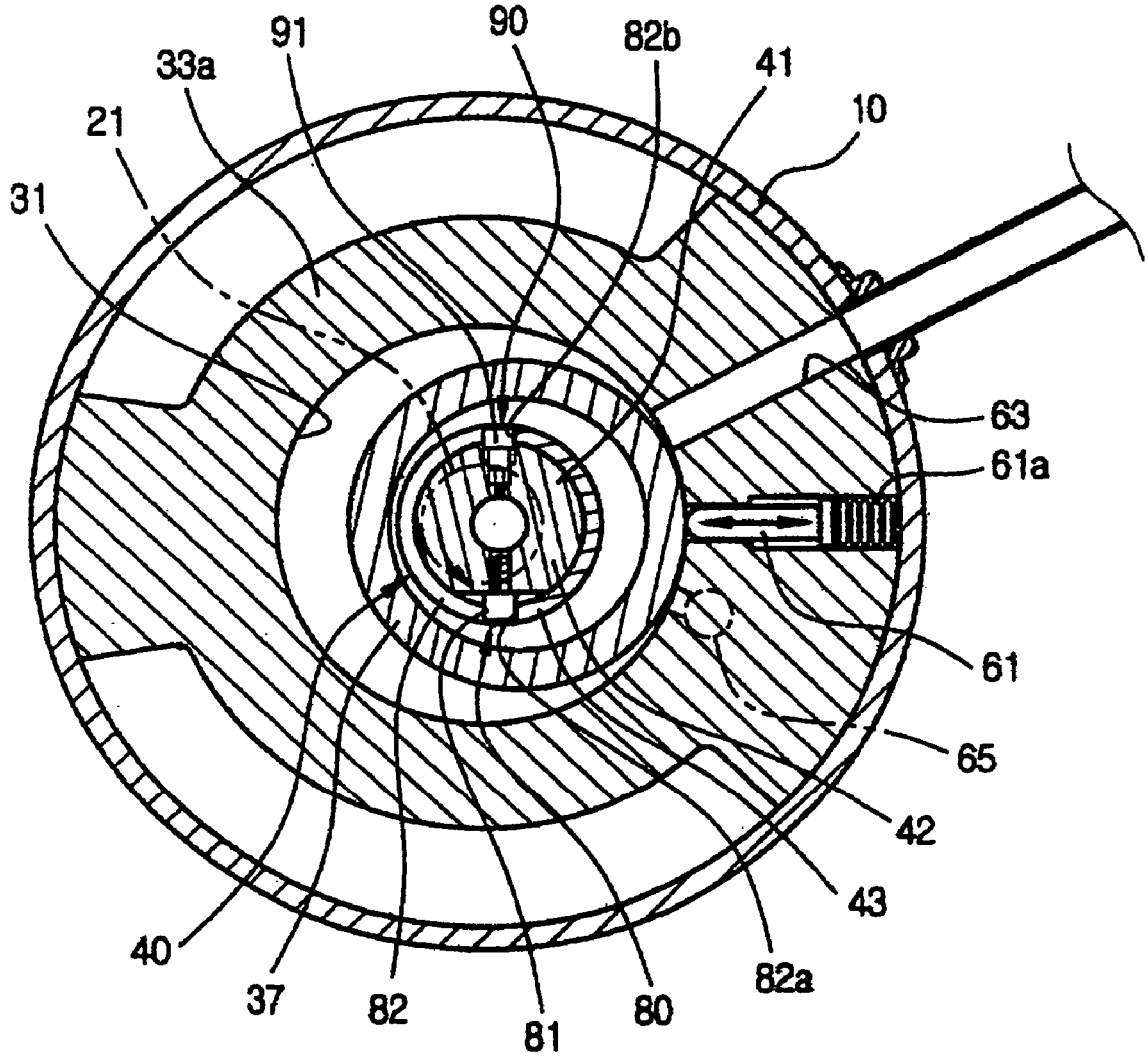
FIG. 3 is a sectional view illustrating a compression operation of a first compression chamber, when a rotating shaft of the variable capacity rotary compressor of FIG. 1 is rotated in a first direction.
Figure 4:
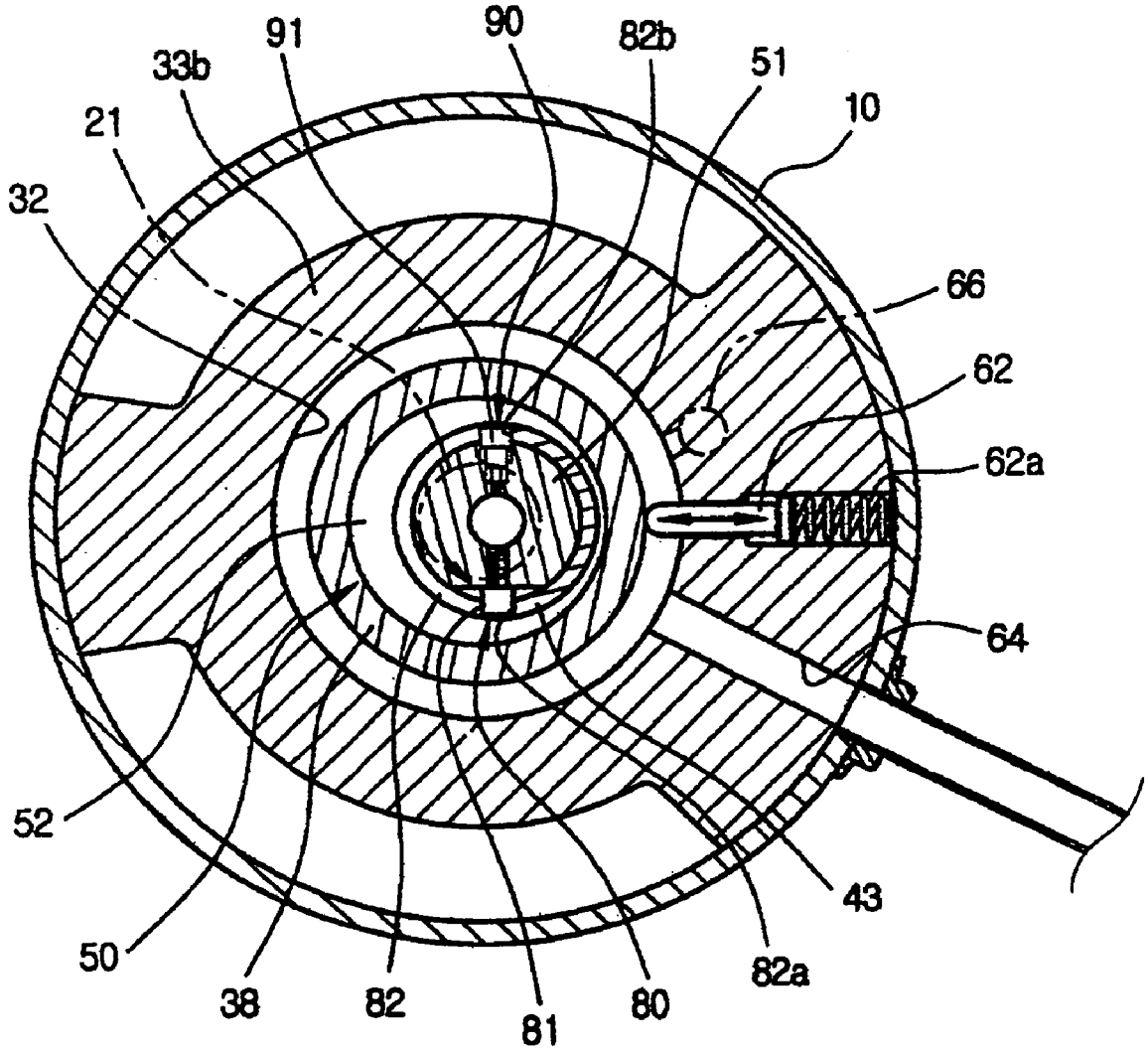
FIG. 4 is a sectional view illustrating an idle operation of a second compression chamber, when the rotating shaft of the variable capacity rotary compressor of FIG. 1 is rotated in the first direction.

As illustrated in FIGS. 2 through 4, first and second eccentric units 40 and 50 are mounted to the rotating shaft 21 to be placed in the first and second compression chambers 31 and 32, respectively. First and second rollers 37 and 38 are rotatably fitted over the first and second eccentric units 40 and 50, respectively. Further, a first vane 61 is installed between an inlet port 63 and an outlet port 65 of the first compression chamber 31, and reciprocates in a radial direction while being in contact with an outer surface of the first roller 37, thus performing a compression operation. A second vane 62 is installed between an inlet port 64 and an outlet port 66 of the second compression chamber 32, and reciprocates in a radial direction while being in contact with an outer surface of the second roller 38, thus performing a compression operation. The first and second vanes 61 and 62 are biased by vane springs 61*a* and 62*a*, respectively. Further, the inlet and outlet ports 63 and 65 of the first compression chamber 31 are arranged on opposite sides of the first vane 61. Similarly, the inlet and outlet ports 64 and 66 of the second compression chamber 32 are arranged on opposite sides of the second vane 62.

The first and second eccentric units 40 and 50 include first and second eccentric cams 41 and 51, respectively. The first and second eccentric cams 41 and 51 are mounted to an outer surface of the rotating shaft 21 to be placed in the first and second compression chambers 31 and 32, respectively, while being eccentric from the rotating shaft 21 in a same direction. First and second eccentric bushes 42 and 52 are rotatably fitted over the first and second eccentric cams 41 and 51, respectively. As illustrated in FIG. 2, the first and second eccentric bushes 42 and 52 are integrally connected to each other by a cylindrical connecting part 43, and are eccentric from the rotating shaft 21 in opposite directions. Further, the first and second rollers 37 and 38 are rotatably fitted over the first and second eccentric bushes 42 and 52, respectively.

As illustrated in FIGS. 2 and 3, an eccentric part 44 is mounted to the outer surface of the rotating shaft 21 between the first and second eccentric cams 41 and 51 to be eccentric from the rotating shaft 21 in a same direction of the eccentric cams 41 and 51. A locking unit 80 and a restraining unit 90 are mounted to the eccentric part 44. In this case, the locking unit 80 functions to make one of the first and second eccentric bushes 42 and 52 be eccentric from the rotating shaft 21 while making a remaining one of the first and second eccentric bushes 42 and 52 be released from eccentricity from the rotating shaft 21, according to a rotating direction of the rotating shaft 21. The restraining unit 90 is outwardly projected from the rotating shaft 21 in a radial direction by a centrifugal force when the rotating shaft 21 is rotated, thus restraining the first and second eccentric bushes 42 and 52.

The locking unit 80 includes a locking pin 81 and a locking slot 82. The locking pin 81 is mounted to a flat surface of the eccentric part 44 in a screw-type fastening method to be projected from the flat surface of the eccentric part 44. The locking slot 82 is provided around a part of the connecting part 43 which connects the first and second eccentric bushes 42 and 52 to each other. The locking pin 81 engages with the locking slot 82 to make one of the first and second eccentric bushes 42 and 52 be eccentric from the rotating shaft 21 while a remaining one of the first and second eccentric bushes 42 and 52 is released from eccentricity from the rotating shaft 21, according to a rotating direction of the rotating shaft 21. That is, when the rotating shaft 21 is rotated, the locking pin 81, mounted to the eccentric part 44 of the rotating shaft 21, engaging with the locking slot 82 of the connecting part 43, is rotated within the locking slot 82 to be locked by either of locking parts 82*a* and 82*b* which are provided at opposite ends of the locking slot 82, thus making the first and second eccentric bushes 42 and 52 be rotated along with the rotating shaft 21. Further, when the locking pin 81 is locked by either of the locking parts 82*a* and 82*b* of the locking slot 82, one of the first and second eccentric bushes 42 and 52 is eccentric from the rotating shaft 21 and a remaining one of the first and second eccentric bushes 42 and 52 is released from eccentricity from the rotating shaft 21. Thus, executing a compression operation in one of the first and second compression chambers 31 and 32 and executing an idle operation in a remaining one of the first and second eccentric bushes 42 and 52 is performed. On the other hand, when a rotating direction of the rotating shaft 21 is changed, the first and second eccentric bushes 42 and 52 are arranged oppositely to the above-mentioned state.

Figure 7:
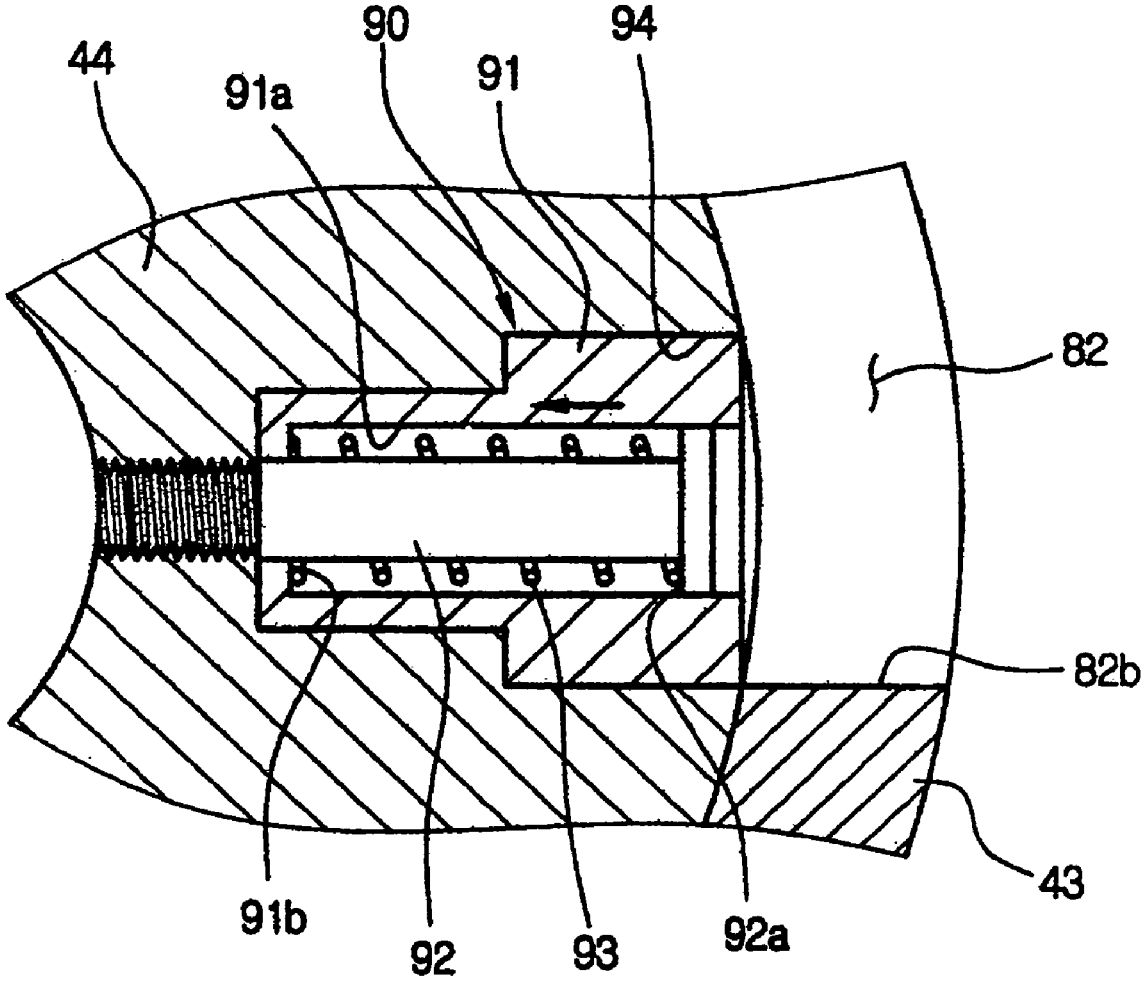
FIG. 7 is an enlarged sectional view of a restraining unit included in the variable capacity rotary compressor of FIG. 1, when an eccentric bush included in the compressor is released from the restraining unit.

As illustrated in FIGS. 2 and 7, the restraining unit 90 is installed at a position opposite to the locking pin 81. The restraining unit 90 includes a restraining member 91, a support pin 92, and a return spring 93. In this case, the restraining member 91 reciprocates in a radial direction of the rotating shaft 21 to be outwardly projected from the eccentric part 44 by the centrifugal force when the rotating shaft 21 is rotated. The support pin 92 functions to guide a reciprocating movement and to restrict a moving range of the restraining member 91. The return spring 93 biases the restraining member 91 toward a central axis of the rotating shaft 21 when the rotating shaft 21 is not rotated.

The restraining member 91 has a stepped outer surface with an outer diameter increased in a direction from an inside to an outside of the rotating shaft 21. A stepped part 94 having a same shape as the stepped outer surface of the restraining member 91 is provided at a predetermined position of the eccentric part 44 of the rotating shaft 21 to receive the restraining member 91 while allowing the restraining member 91 to be retractable. Further, a through hole 91*a* is provided through a center of the restraining member 91. The support pin 92, which guides the reciprocating movement of the restraining member 91 passes through the through hole 91*a* of the restraining member 91 to be mounted to the stepped part 94 in a screw-type fastening method. The return spring 93 is placed between an inner surface of the restraining member 91 and an outer surface of the support pin 92. In this case, the return spring 93 is supported, at a first end thereof, by a stepped stop part 92*a* which is provided at an end of the support pin 92 and has a larger diameter, and is supported, at a second end thereof, by a stepped locking portion 91*b* which is provided on an inner surface of the restraining member 91.

Figure 8:
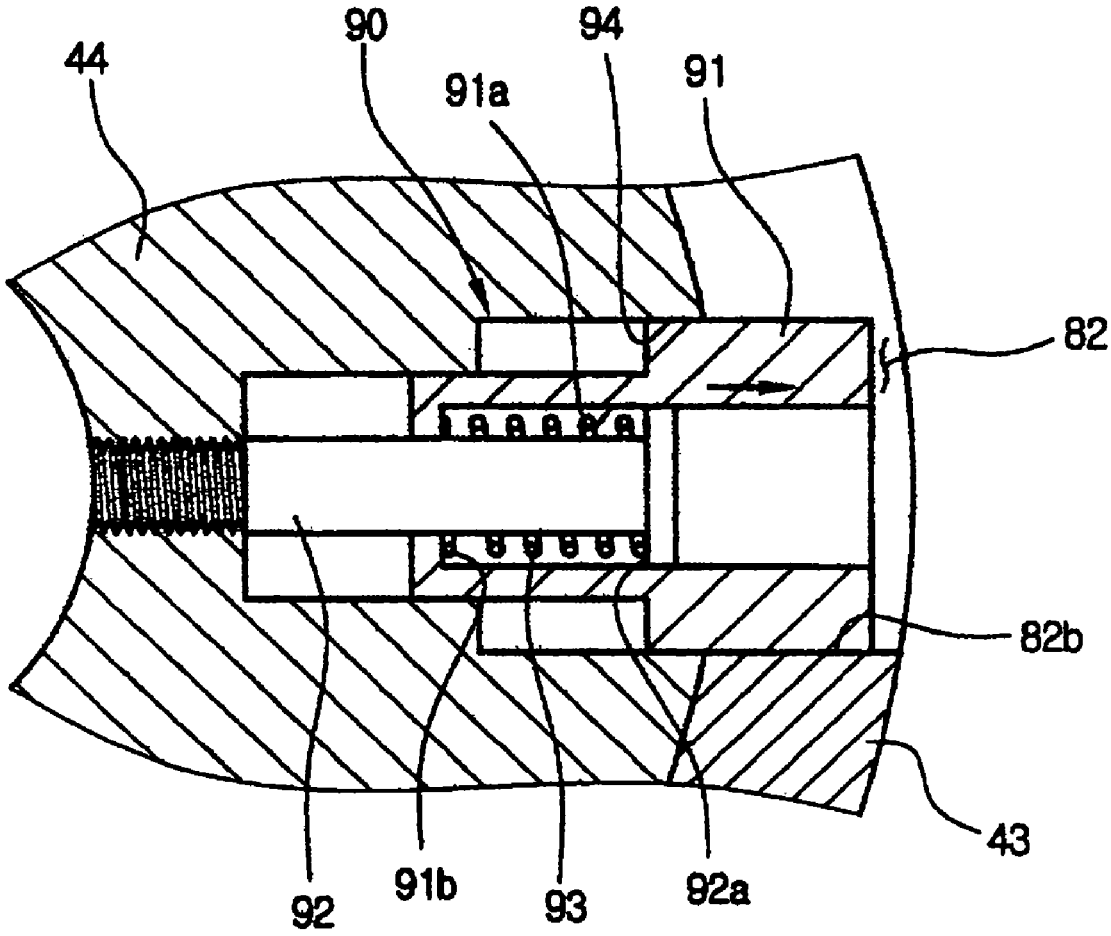
FIG. 8 is an enlarged sectional view of the restraining unit included in the variable capacity rotary compressor of FIG. 1, when an eccentric bush included in the compressor is restrained by the restraining unit.

In the restraining unit 90 of FIG. 8, the restraining member 91 is projected in the radial direction of the rotating shaft 21 by the centrifugal force when the rotating shaft 21 is rotated, thus engaging with the locking part 82*b* of the locking slot 82 which is positioned opposite to the locking pin 81, therefore restraining the eccentric bushes 42 and 52. That is, the locking pin 81 is locked by one of the locking parts 82*a* and 82*b* while the restraining member 91 is locked by a remaining one of the locking parts 82*a* and 82*b*, thus allowing the eccentric bushes 42 and 52 to be completely restrained when the rotating shaft 21 is rotated. On the other hand, when the rotating shaft 21 is not rotated, the restraining member 91 is retracted into the eccentric part 44 by a restoring force of the return spring 93, thus releasing the eccentric bushes 42 and 52.

As illustrated in FIG. 1, the variable capacity rotary compressor according to the present invention also includes a path control unit 70. The path control unit 70 controls a refrigerant intake path to make a refrigerant fed from a refrigerant inlet pipe 69 be drawn into the inlet port 63 of the first compression chamber 31 or the inlet port 64 of the second compression chamber 32, (that is, the inlet port of a compression chamber where the compression operation is executed).

The path control unit 70 includes a hollow cylindrical body 71, and a valve unit installed in the body 71. An inlet 72 is provided at a central portion of the body 71 to be connected to the refrigerant inlet pipe 69. First and second outlets 73 and 74 are provided on opposite sides of the body 71. Two pipes 67 and 68, which are connected to the inlet port 63 of the first compression chamber 31 and the inlet port 64 of the second compression chamber 32, respectively, are connected to the first and second outlets 73 and 74, respectively. Further, the valve unit includes a valve seat 75, first and second valve members 76 and 77, and a connecting member 78. The valve seat 75 has a cylindrical shape, and is opened at both ends thereof. The first and second valve members 76 and 77 are installed on both sides in the body 71, and axially reciprocate in the body 71 to open or close both ends of the valve seat 75. The connecting member 78 connects the first and second valve members 76 and 77 to each other to allow the first and second valve members 76 and 77 to move together. In this case, the path control unit 70 is operated as follows.

When the compression operation is executed in either of the first and second compression chambers 31 and 32, the first and second valve members 77 set in the body 71 move in a direction toward one of the two outlets 73 and 74 having a lower pressure due to a difference in pressure between the two outlets 73 and 74, thus automatically changing a refrigerant intake path.

The operation of the variable capacity rotary compressor according to the present invention will be described as follows.

As illustrated in FIG. 3, when the rotating shaft 21 is rotated in a direction, an outer surface of the first eccentric bush 42 in the first compression chamber 31 is eccentric from the rotating shaft 21 and the locking pin 81 is locked by the locking part 82*a* of the locking slot 82. Thus, the first roller 37 is rotated while coming into contact with an inner surface of the first compression chamber 31, thus executing the compression operation in the first compression chamber 31. At this time, the second eccentric bush 52 is arranged in the second compression chamber 32 as illustrated in FIG. 4. That is, an outer surface of the second eccentric bush 52, which is eccentric in a direction opposite to the first eccentric bush 42, is concentric with the rotating shaft 21, and the second roller 38 is spaced apart from an inner surface of the second compression chamber 32, thus an idle rotation is executed in the second compression chamber 32. Further, when the compression operation is executed in the first compression chamber 31, the refrigerant is drawn into the inlet port 63 of the first compression chamber 31. In this case, the path control unit 70 controls the refrigerant intake path to draw the refrigerant into the first compression chamber 31.

The compressor of the present invention is operated in this way because the first and second eccentric cams 41 and 51 are eccentric from the rotating shaft 21 in a same direction while the first and second eccentric bushes 42 and 52 are eccentric from the rotating shaft 21 in opposite directions. That is, when a maximum eccentric part of the first eccentric cam 41 and a maximum eccentric part of the first eccentric bush 42 are arranged in a same direction, a maximum eccentric part of the second eccentric cam 51 and a maximum eccentric part of the second eccentric bush 52 are arranged in opposite directions, thus allowing the compressor of the present invention to be operated as described above.

When the compression operation is executed, as illustrated in FIG. 8, the restraining member 91 is outwardly projected from the rotating shaft 21 by the centrifugal force due to the rotation of the rotating shaft 21. At this time, the restraining member 91 is locked by the locking part 82*b* of the locking slot 82 which is positioned opposite to the locking pin 81, thus restraining the eccentric bushes 42 and 52. Thus, the restraining member 91 prevents the eccentric bushes 42 and 52 from being rotated at a faster speed than the eccentric cams 41 and 51, thereby preventing the eccentric bushes 42 and 52 from slipping over the eccentric cams 41 and 51, and preventing the locking pin 81 from colliding with the locking parts 82*a* and 82*b* of the locking slot 82.

Thus, according to a conventional variable capacity rotary compressor, when an eccentric bush of a compression chamber, where the compression operation is executed, is rotated toward an inlet port after passing an outlet port and a vane, some of a compressed gas returns to the compression chamber without being discharged through the outlet port, and expands again. At this time, the eccentric bush is momentarily rotated at a faster speed than an associated eccentric cam, thus the eccentric bush slips over the eccentric cam. However, according to the present invention, the restraining member 91 restrains the eccentric bushes 42 and 52 and prevents slippage and collision from occurring, therefore reducing noises, and enhancing durability and reliability.

When the compressor is stopped, the restraining member 91 is retracted into the eccentric part 44 by the restoring force of the return spring 93, thus the restraining unit 90 releases the eccentric bushes 42 and 52. Meanwhile, when the rotating shaft 21 is rotated in a direction opposite to the direction described above, the locking pin 81 is rotated within the locking slot 82 in a direction away from the locking part 82*a* to the locking part 82*b*. At this time, since the restraining member 91 is retracted into the eccentric part 44, the rotating shaft 21 is smoothly rotated without being hindered by the restraining member 91 and the connecting part 43. In this way, it is possible to easily change positions of the locking pin 81 and the restraining member 91. While the positions of the locking pin 81 and the restraining member 91 are changed, only the rotating shaft 21 is rotated by a predetermined range without the rotation of the eccentric bushes 42 and 52.

Figure 5:
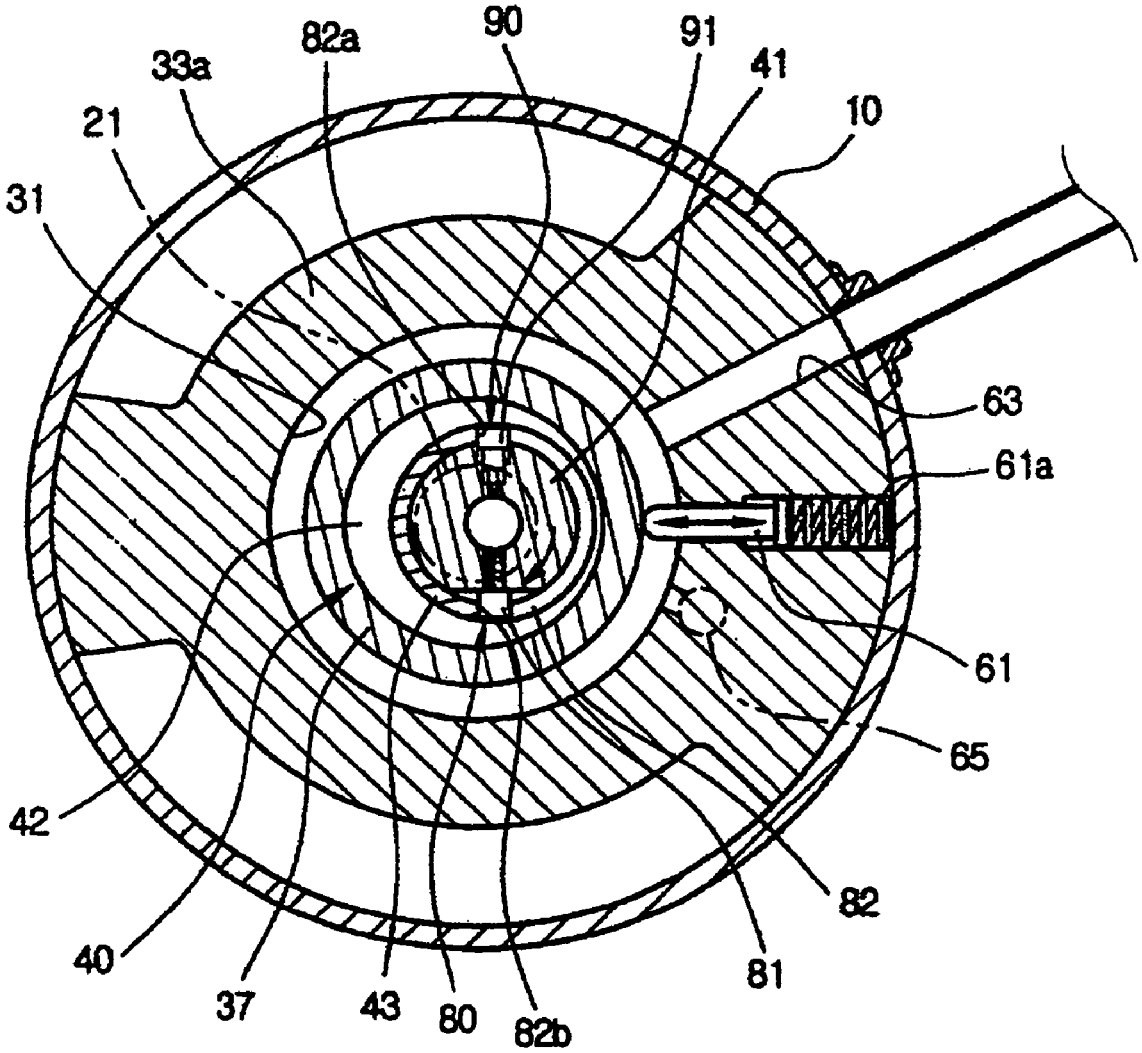
FIG. 5 is a sectional view illustrating an idle operation of the first compression chamber, when the rotating shaft of the variable capacity rotary compressor of FIG. 1 is rotated in a second direction.
Figure 6:
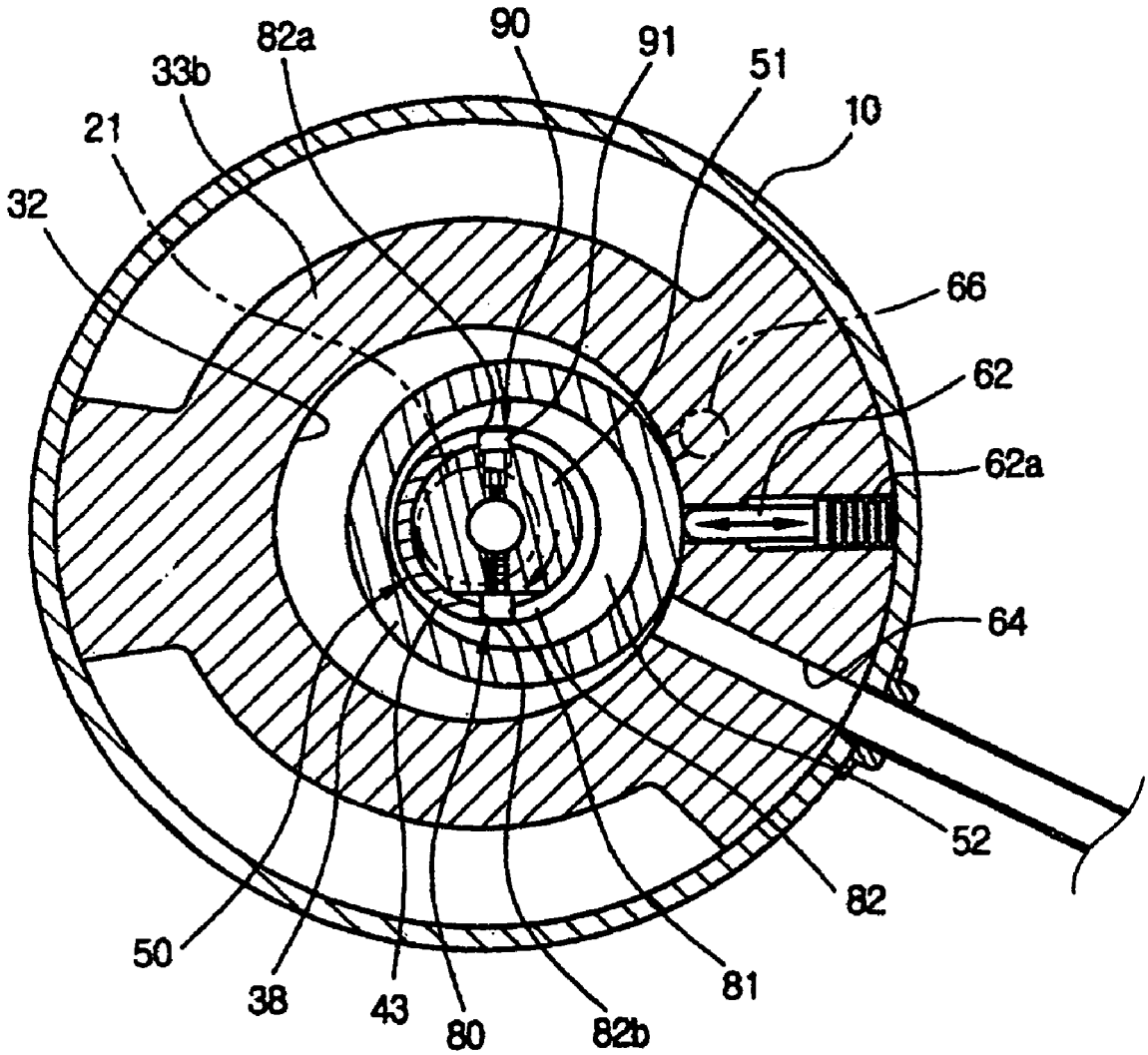
FIG. 6 is a sectional view illustrating a compression operation of the second compression chamber, when the rotating shaft of the variable capacity rotary compressor of FIG. 1 is rotated in the second direction.

When the rotating shaft 21 is rotated in a direction opposite to the direction shown in FIG. 3 to execute the compression operation, the outer surface of the first eccentric bush 42 in the first compression chamber 31 is released from eccentricity from the rotating shaft 21 and the locking pin 81 engages with the locking part 82*b* of the locking slot 82, as illustrated in FIG. 5. At this time, the first roller 37 is rotated while being spaced apart from the inner surface of the first compression chamber 31, thus the idle rotation is executed in the first compression chamber 31. Meanwhile, the outer surface of the second eccentric bush 52 in the second compression chamber 32 is eccentric from the rotating shaft 21, and the second roller 38 is rotated while being in contact with the inner surface of the second compression chamber 32, as illustrated in FIG. 6. At this time, the compression operation is executed in the second compression chamber 32.

When the compression operation is executed in the second compression chamber 32, the refrigerant is drawn into the inlet port 64 of the second compression chamber 32. Thus, the path control unit 70 controls the refrigerant intake path to draw the refrigerant into the second compression chamber 32. Further, the restraining member 91 is outwardly projected from the rotating shaft 21 by the centrifugal force when the rotating shaft 21 is rotated. At this time, the restraining member 91 is locked by the locking part 82*a* of the locking slot 82 which is positioned opposite to the locking pin 81, thus restraining the eccentric bushes 42 and 52.

Figure 9:
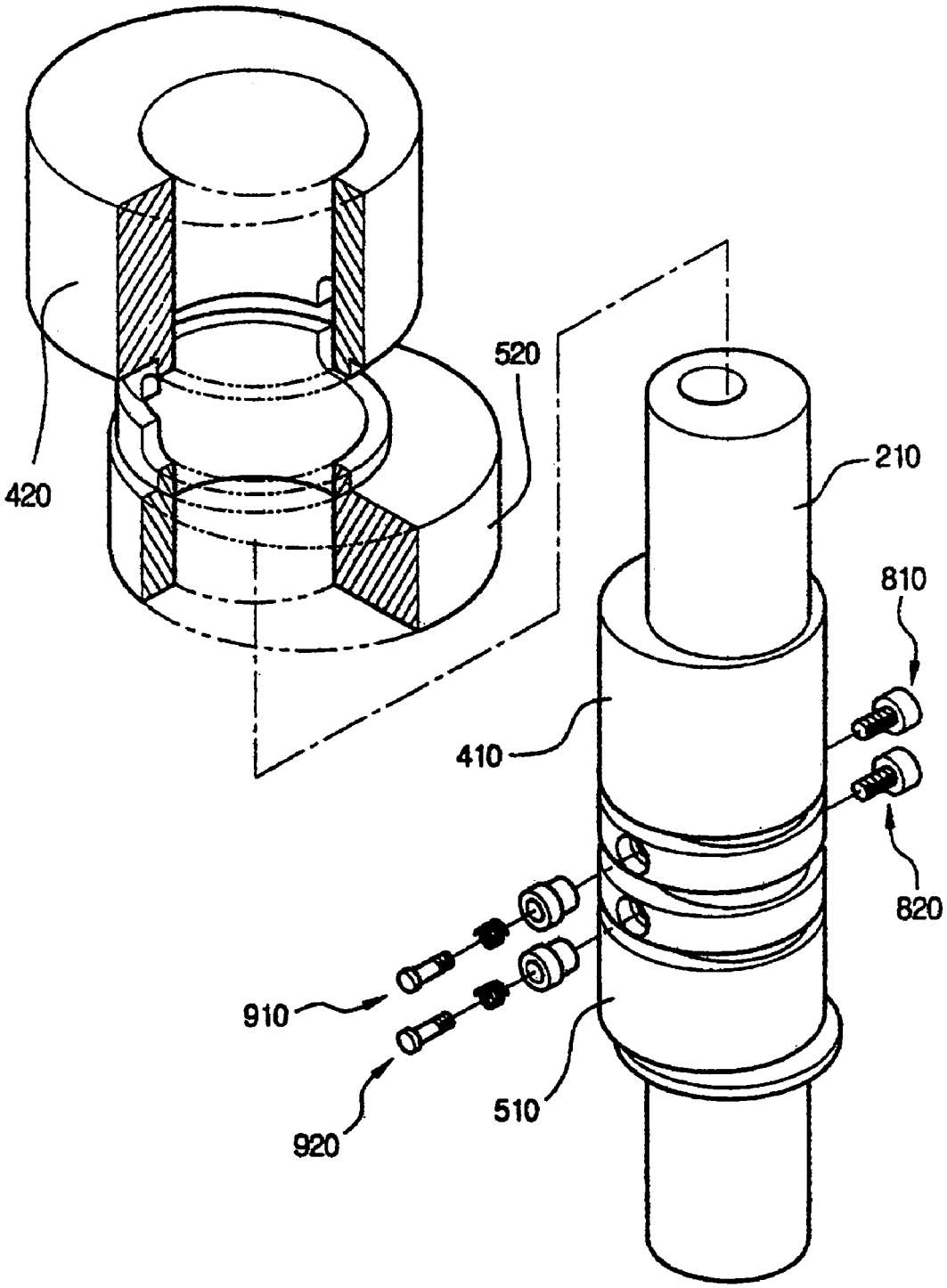
FIG. 9 is an exploded perspective view illustrating an eccentric unit included in a variable capacity rotary compressor, according to another embodiment of the present invention.

FIG. 9 illustrates an eccentric unit included in a variable capacity rotary compressor, according to another embodiment of the present invention. In the variable capacity rotary compressor of FIG. 9, first and second eccentric bushes 420 and 520 are separated from each other, and a first locking unit 810 and a first restraining unit 910 to lock and restrain the first eccentric bush 420 are provided separately from a second locking unit 820 and a second restraining unit 920 to lock and restrain the second eccentric bush 520. The general shape of the variable capacity rotary compressor of FIG. 9 remains the same as the variable capacity rotary compressor of FIGS. 1 through 8, except for the locking unit and restraining unit.

In FIG. 9, first and second eccentric cams 410 and 510 are mounted to a rotating shaft 210 to be eccentric from a rotating shaft 210 in a same direction. Further, the first and second locking units 810 and 820 are installed to be placed along a same axial position, and the first and second restraining units 910 and 920 are also installed to be placed along a same axial position. Alternatively, the first and second eccentric cams 410 and 510 may be installed to be eccentric from the rotating shaft 210 in opposite directions. Further, the first and second locking units 810 and 820 may be installed in opposite directions and the first and second restraining units 910 and 920 may be also installed in opposite directions.

As is apparent from the above description, the present invention provides a variable capacity rotary compressor, which is designed to execute a compression operation in either of two compression chambers having different capacities by an eccentric unit which rotates in the first or second direction, thus varying a compression capacity of the compressor as desired.

Further, the present invention provides a variable capacity rotary compressor, which is designed to make a restraining unit be outwardly projected from an eccentric part by a centrifugal force when the rotating shaft is rotated to execute a compression operation, thus restraining eccentric bushes to prevent the eccentric bushes from slipping, thereby reducing noise while enhancing durability and reliability.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A variable capacity rotary compressor, comprising:

a housing to define first and second compression chambers having different capacities therein;

a rotating shaft to be placed in the first and second compression chambers;

first and second eccentric cams mounted to the rotating shaft and placed in the first and second compression chambers, respectively;

first and second eccentric bushes rotatably fitted over the first and second eccentric cams, respectively;

a locking unit to make one of the first and second eccentric bushes be eccentric from the rotating shaft while making a remaining one of the first and second eccentric bushes be released from eccentricity from the rotating shaft, according to a rotating direction of the rotating shaft, the first and second eccentric bushes being eccentric in opposite directions; and a restraining unit outwardly projected from the rotating shaft by a centrifugal force when the rotating shaft is rotated, to restrain the first and second eccentric bushes.

2. The rotary compressor according to claim 1, wherein the restraining unit comprises:

a restraining member to reciprocate in a radial direction of the rotating shaft to be outwardly projected from the rotating shaft by the centrifugal force when the rotating shaft is rotated;

a locking part provided at a predetermined position of the first and second eccentric bushes to be locked by the restraining member when the restraining member is outwardly projected from the rotating shaft; and a return spring included in the rotating shaft to inwardly bias the restraining member in the radial direction toward a central axis of the rotating shaft when the rotating shaft is not rotated, releasing the eccentric bushes.

3. The rotary compressor according to claim 2, wherein the restraining unit further comprises:

a support pin mounted to the rotating shaft, to pass through the restraining member in a longitudinal direction of the restraining member, and to guide a reciprocating movement and to restrict a moving range of the restraining member, with the return spring being placed between an inner surface of the restraining member and an outer surface of the support pin which passes through the restraining member.

4. The rotary compressor according to claim 1, wherein the locking unit comprises:

a locking pin mounted to the rotating shaft, to project from the locking pin; and locking parts provided at opposite positions of the eccentric bushes, respectively, to allow the locking pin to be locked by either of the locking parts to make one of the first and second eccentric bushes be eccentric from the rotating shaft while making the remaining one of the first and second eccentric bushes be released from eccentricity from the rotating shaft, according to the rotating direction of the rotating shaft.

5. The rotary compressor according to claim 4, wherein the restraining unit comprises:

a restraining member installed in the rotating shaft at a position opposite to the locking pin, to reciprocate in a radial direction of the rotating shaft and to outwardly project from the rotating shaft by the centrifugal force when the rotating shaft is rotated;

a support pin mounted to the rotating shaft, to pass through the restraining member in a longitudinal direction of the restraining member, and to guide a reciprocating movement and to restrict a moving range of the restraining member; and a return spring placed between an inner surface of the restraining member through which the support pin passes, and an outer surface of the support pin to inwardly bias the restraining member toward a central axis of the rotating shaft when the rotating shaft is not rotated, releasing the eccentric bushes.

6. A variable capacity rotary compressor, comprising:

a housing to define first and second compression chambers having different capacities therein;

a rotating shaft to be placed in the first and second compression chambers;

first and second eccentric cams mounted to the rotating shaft placed in the first and second compression chambers, respectively;

first and second eccentric bushes rotatably fitted over the first and second eccentric cams, respectively;

a cylindrical connecting part to connect the first and second eccentric bushes to each other while making the first and second eccentric bushes be eccentrically positioned from the rotating shaft in opposite directions;

a locking unit to make one of the first and second eccentric bushes be eccentric from the rotating shaft while making a remaining one of the first and second eccentric bushes be released from eccentricity from the rotating shaft, according to a rotating direction of the rotating shaft, the first and second eccentric bushes being eccentric in opposite directions; and a restraining unit outwardly projected from the rotating shaft by a centrifugal force when the rotating shaft is rotated, restraining the first and second eccentric bushes.

7. The rotary compressor according to claim 6, wherein the locking unit comprises:

a locking pin mounted to the rotating shaft, to project from the rotating shaft; and a locking slot provided around the cylindrical connecting part, to engage with the locking pin which is rotated by a predetermined range within the locking slot, one of the first and second eccentric bushes being eccentric from the rotating shaft while a remaining one of the first and second eccentric bushes being released from eccentricity from the rotating shaft when the locking pin is in contact with one of first and second ends of the locking slot.

8. The rotary compressor according to claim 7, wherein the locking pin is mounted to the rotating shaft via a screw-type fastening.

9. The rotary compressor according to claim 7, wherein the restraining unit comprises:

a restraining member installed in the rotating shaft at a position opposite to the locking pin, to reciprocate in a radial direction of the rotating shaft and to outwardly project from the rotating shaft by the centrifugal force when the rotating shaft is rotated, the restraining member being locked by an end of the locking slot which is opposite to the locking pin; and a return spring included in the rotating shaft, to inwardly bias the restraining member toward a central axis of the rotating shaft when the rotating shaft is not rotated, releasing the eccentric bushes.

10. The rotary compressor according to claim 9, wherein the restraining unit further comprises:

a support pin which is mounted to the rotating shaft, to pass through the restraining member in a longitudinal direction of the restraining member, and to guide a reciprocating movement and to restrict a moving range of the restraining member, with the return spring being placed between an inner surface of the restraining member and an outer surface of the support pin which passes through the restraining member.

11. The rotary compressor according to claim 10, further comprising:

a stepped stop part having a large diameter and provided at an end of the support pin; and a stepped locking portion provided on an inner surface of the restraining member, wherein the return spring is supported at a first end thereof by the stepped stop part, and is supported at a second end thereof by the stepped locking portion.

12. The rotary compressor according to claim 9, wherein the restraining member has a stepped outer surface with an outer diameter increased in a direction from an inside to an outside of the rotating shaft, and a stepped part, having a same shape as the stepped outer surface of the restraining member and provided at a predetermined portion of the rotating shaft, to receive the restraining member therein while allowing the restraining member to be retractable.

13. The rotary compressor according to claim 6, further comprising:

an eccentric part having a same shape as the eccentric cams and provided on an outer surface of the rotating shaft, to allow the locking unit and the restraining unit to be mounted to the rotating shaft through the eccentric part.

14. The rotary compressor according to claim 13, wherein the eccentric part is mounted to an outer surface of the rotating shaft between the first and second eccentric cams to be eccentric from the rotating shaft in a same direction of the first and second eccentric cams.

15. The rotary compressor according to claim 6, further comprising:

upper and lower flanges to rotatably support the rotating shaft; and a partition plate located in the housing to partition the first and second compression chambers into each other.

16. The rotary compressor according to claim 6, further comprising:

first and second rollers to rotatably fit over the first and second eccentric cams, respectively;

a first vane installed between an inlet port and an outlet port of the first compression chamber, to reciprocate in a radial direction while being in contact with an outer surface of the first roller;

a second vane installed between an inlet port and an outlet port of the second compression chamber, to reciprocate in a radial direction while being in contact with an outer surface of the second roller; and first and second vane springs to bias the first and second vanes, respectively, wherein the inlet and outlet ports of the first compression chamber are arranged on opposite sides of the first vane, and the inlet and outlet ports of the second compression chamber are arranged on opposite sides of the second vane.

17. The rotary compressor according to claim 16, wherein the first and second rollers are rotatably fitted over the first and second eccentric bushes, respectively.

18. The rotary compressor according to claim 6, wherein the first and second eccentric cams are mounted to an outer surface of the rotating shaft to be placed in the first and second compression chambers, respectively, while being eccentric from the rotating shaft in a same direction.

19. The rotary compressor according to claim 6, further comprising:

a path control unit to control a refrigerant intake path to make a refrigerant fed from a refrigerant inlet pipe be drawn into an inlet port of the first compression chamber or an inlet port of the second compression chamber.

20. A variable capacity rotary compressor including a housing to define first and second compression chambers having different capacities therein, the compressor comprising:

a rotating shaft to be placed in the first and second compression chambers;

a restraining unit outwardly projected from the rotating shaft by a centrifugal force when the rotating shaft is rotated to execute a compression operation, restraining eccentric bushes provided in the compressor to prevent the eccentric bushes from slipping; and a locking part provided at a predetermined position of the eccentric bushes to be locked by the restraining unit when the restraining unit is outwardly projected from the rotating shaft.

* * * * *